United States Patent [19]

Yamauchi et al.

[11] Patent Number: 5,060,714

[45] Date of Patent: Oct. 29, 1991

[54] APPARATUS FOR CONTINUOUS CASTING OF METAL STRIP

[75] Inventors: Takashi Yamauchi, Kudamatsu; Morihiro Hasegawa, Tokuyama, both of Japan

[73] Assignee: Nisshin Steel Co., Ltd., Tokyo, Japan

[21] Appl. No.: 477,865

[22] PCT Filed: Aug. 8, 1989

[86] PCT No.: PCT/JP89/00808

§ 371 Date: Apr. 9, 1990

§ 102(e) Date: Apr. 9, 1990

[87] PCT Pub. No.: WO90/01382

PCT Pub. Date: Feb. 22, 1990

[30] Foreign Application Priority Data

Aug. 10, 1988 [JP] Japan ..... 63-197960

[51] Int. Cl.[5] ..... B22D 11/06

[52] U.S. Cl. ..... 164/428; 164/480

[58] Field of Search ..... 164/428, 480, 429, 479

[56] References Cited

U.S. PATENT DOCUMENTS 4,811,780 3/1989 Yamauchi et al. ..... 164/480

FOREIGN PATENT DOCUMENTS 2-34252 2/1990 Japan ..... 164/428

*Primary Examiner*—Kuang Y. Lin

*Attorney, Agent, or Firm*—Lowe, Price, LeBlanc & Becker

[57] ABSTRACT

Proposed herein is a twin roll continuous casting apparatus for continuously casting a metal strip through a gap of a pair of internally cooled rolls rotating in the opposite direction to each other having a pair of abradable side dams disposed on both sides of the rolls so that at least a portion of the thickness of each of the side dams is located on the circumferential surfaces of the rolls to form a pool of molten metal on the circumferential surfaces of the rolls, and a mechanism for feeding each of the side dams in the casting direction, each side dam comprising an assembly of successively stacked unit blocks in which one unit block except for the lowest one is placed one another unit block so that no clearance is formed between the lower end of the former and the upper end of the latter, portions of the circumferential surfaces of the rolls contacting the side dams being formed into rough surfaces having abrading ability.

6 Claims, 4 Drawing Sheets

Fig. 2
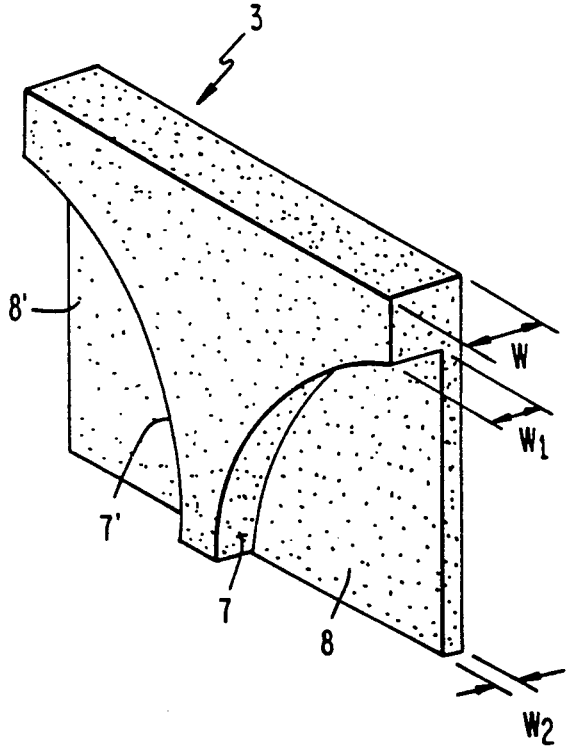
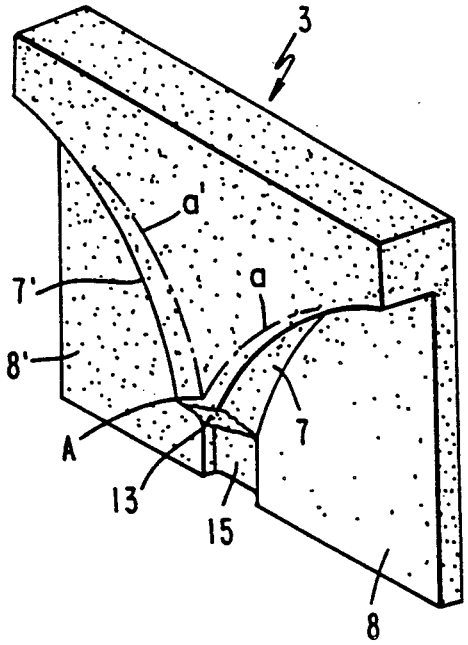
Fig. 3

APPARATUS FOR CONTINUOUS CASTING OF METAL STRIP

TECHNICAL FIELD OF THE INVENTION

The present invention relates to an improvement in a twin roll continuous casting apparatus for continuously casting a metal strip directly from a molten metal such as a molten steel.

BACKGROUND OF THE INVENTION

Well known in the art is a so-called twin roll continuous casting apparatus in which a pair of internally cooled rolls having respectively horizontal axes and rotating in opposite direction to each other are disposed parallel to each other with an appropriate gap therebetween, a pool of molten metal is formed on the circumferential surfaces (the upper halves of cylindrical surfaces in the axial directions) of the rolls above the gap and the molten metal is continuously cast into a metal strip through the gap while being cooled by the circumferential surfaces of the rotating rolls. There has also been proposed such a twin roll continuous apparatus applied to a case of continuous casting of steel to produce a steel strip directly from molten steel.

When a metal strip is continuously cast through a gap between a pair of rolls, it is necessary to form a pool of molten metal on the circumferential surfaces of the pair of rolls above the gap therebetween and to maintain a level of the molten metal in the pool substantially constant by continuously pouring the molten metal into the pool. In order to form the pool of molten metal, there are required a pair of dams having their surfaces perpendicular to the roll axes which prevent an overflow of molten metal along the roll axes on the circumferential surfaces of the rolls. These dams also serve usually to regulate the width of the cast strip and are referred to herein as "side dams". In addition to the side dams disposed at the left and right sides of the rolls, a pair of front and rear dams (referred to herein as "longitudinal dams") having their surfaces along the roll axes may be erected orthogonally to the side dams on the circumferential surfaces of the rolls so as to form a box-like pool for molten metal with the side dams and the longitudinal dams. However, when the pair of rolls have sufficiently large radii respectively, the front and rear gates along the roll axes are not always needed. In this case, the circumferential surfaces of the pair of rolls may fulfill by themselves roles of the front and rear gates.

There are known, as the pair of side dams, movable side dams which urge a pair of endless metal belts, caterpillars and the like against both edge surfaces of the rolls (side surfaces of the rolls perpendicular to the roll axes) at a location of the roll gap and move at a speed corresponding to the casting speed, and fixed side dams which have plate-like bodies of refractories fixed to left and right side surfaces of the rolls. Generally, with the latter fixed side dams, the constitution of the apparatus is simple and the control of running is not complicated, compared with the former movable side dams. Also known in the art is a system of combined side dams in which fixed side dams are combined with movable side dams. See JP A-62-214,835 which corresponds to U.S. Pat. No. 4,754,802.

Two systems of the fixed side dams are known. One is a system in which the distance between the plate-like bodies of the fixed side dams is smaller than the roll width (the length of roll from one end to the other end), and the other is a system in which the distance is the same as the roll width. According to the former system, the pair of side dams are erected on the circumferential surfaces of the rolls such that the bottoms of the side dams slidably contact the circumferential surfaces of the rolls. According to the latter system, the side dams are fixedly provided so that the respective inside surfaces of the side dams slidably contact the side surfaces of the rolls, that is, the pair of side dams sandwich the pair of rolls on the side surfaces of the rolls.

Usually, the fixed side dams are made of refractory material having a good adiabatic property. This is because the molten metal contacting the side dams has to be prevented from being solidified on the surfaces of the side dams. Adiabatic refractory materials generally have inferior wear resistance to that of solidified metal and liable to have scratches. Thus, the fixed refractory side dams may be damaged during the running of the apparatus, and the increase of damages may bring about break-out of molten metal. Further, according to the system noted above in which the side dams are fixed so that they sandwich the rolls on their side surfaces, clearances may be formed between the side surfaces of the rolls and the inside surfaces of the side dams slidably contacting therewith due to pressure of the ends of the strip being cast applied at the time of passing through the roll gap, and the molten metal may enter the clearances. If such troubles occur, stable casting may no longer be continued. Accordingly, it has generally been considered that refractory materials suitable for the side dams should have a good wear resistance and the highest possible strength.

In either side dam system, during the continuous casting, a portion of molten metal in the pool forms thin solidified shells respectively on the surfaces of the rotating rolls, and then these shells pass through the gap between the twin rolls while growing along with rotation of the rolls. At this time, the solidified shells are depressed (rolled) at a portion in the neighborhood of the smallest gap between the rolls to form into a metal strip of a predetermined thickness. Thus, owing to this depression (rolling), the solidified shells tend to expand widthwise near the roll gap. As a result, the ends of the cast strip apply large pressure to the side dams. In the case of the movable side dams wherein the side dams are moved at a speed corresponding to the casting speed, a problem of friction between the side dams and the ends of of the cast strip is not substantially posed. In the case of the fixed side dams, however, large friction is inevitably generated between the ends of the moving cast strip and the fixed side dams, and can be a cause of damages of the refractory side dams, occurrence of cracking and undesirable deformation of the ends of the cast strip, formation of clearances between the side surfaces of the rolls and the inside surfaces of the side dams slidably contacting therewith, and entrance of molten metal into the clearances so formed, all of which hinder stable continuous casting. These problems are especially serious in the case of continuous casting of steel wherein the material involved is higher melting and has higher strength, when compared with cases wherein lower-melting and mild non-ferrous metals are concerned.

In Japanese Patent Application No. 62-84,555 (published as JP A-63-252,646 on Oct. 19, 1988, after the priority date of the present international application, that is, July 22, 1988; the corresponding U.S. patent application was issued as U.S. Pat. No. 4,811,780 on Mar. 14, 1989.), we have proposed as a solution to the above-discussed problems a continuous casting apparatus for metal strip which may be said "abradable dam system" or "semimovable dam system" intermediate between "movable" and "fixed" dam systems. According to our prior proposal, a refractory material capable of being well abraded is used as the material for the side dams, contrary to the prior art concept that refractory materials suitable for the side dams should have a good wear resistance and the highest possible strength. The abradable side dams are forcibly fed or moved in the casting direction during the casting while being frictionally abraded by slidably contacting surfaces of the rotating rolls and ends of the strip being cast. Repeated runs of continuous casting by the abradable dam system have indicated that further improvements are desired in order to ensure stable abrasion of the side dams.

OBJECT OF THE INVENTION

An object of the invention is to provide an improvement of the twin roll continuous casting apparatus of the abradable dam system proposed in Japanese Patent Application No. 62-84,555.

SUMMARY OF THE INVENTION

An apparatus for continuously casting a metal strip according to the invention comprises a pair of internally cooled rolls rotating in the opposite direction to each other and disposed parallel to each other with their axes held horizontal, a pair of side dams composed of a well-abradable refractory disposed with a space therebetween approximately corresponding to the width of a metal strip to be cast so that at least a portion of the thickness of each of the side dams is located on the circumferential surfaces of the rolls to form a pool of molten metal on the circumferential surfaces of the rolls, and a mechanism for feeding each of the side dams in the casting direction thereby continuously casting molten metal in the pool into a metal strip through a gap between the pair of rolls while abrading the side dams at their portions contacting the circumferential surfaces of the rolls with the circumferential surfaces of the rolls, characterized in that each of said abradable side dams comprises an assembly of successively stacked unit blocks in which one unit block except for the lowest one is placed on another unit block so that no clearance is formed between the lower end of the former and the upper end of the latter and that said mechanism for feeding each of the side dams is capable of feeding the assembly as a whole in the casting direction. Thus, with the apparatus according to the invention the casting operation is continued while a fresh unit block is successively added on the top of each assembly of stacked unit blocks as the lowest unit block of the assembly is abrasively worn by running the apparatus. The unit blocks may be in the form of a rectangular plate having substantially the same thickness and such upper and lower ends that when one block is stacked on another unit block with the lower end of the one block placed on the upper end of the other, no clearance is formed between them. The assemblies of stacked unit blocks are supported by guide frames so that they may be guided in the casting direction, and fed in the casting direction at a predetermined speed by a mechanism for feeding them in the casting direction.

BRIEF DESCRIPTION OF THE DRAWINGS

FIG. 2 is a perspective view of the inside shape of the lowest unit block of the side dam in the apparatus of FIG. 1 in slidable contact with the circumferential surfaces of the rolls prior to the casting process or at the time the casting process is started;

FIG. 3 is a similar view of the block of FIG. 2 under the condition where the degree of abrasion of the block is proceeded in the casting process;

DETAILED DESCRIPTION OF THE INVENTION

The invention will now be described in detail with reference to the drawings.

Figure 1:
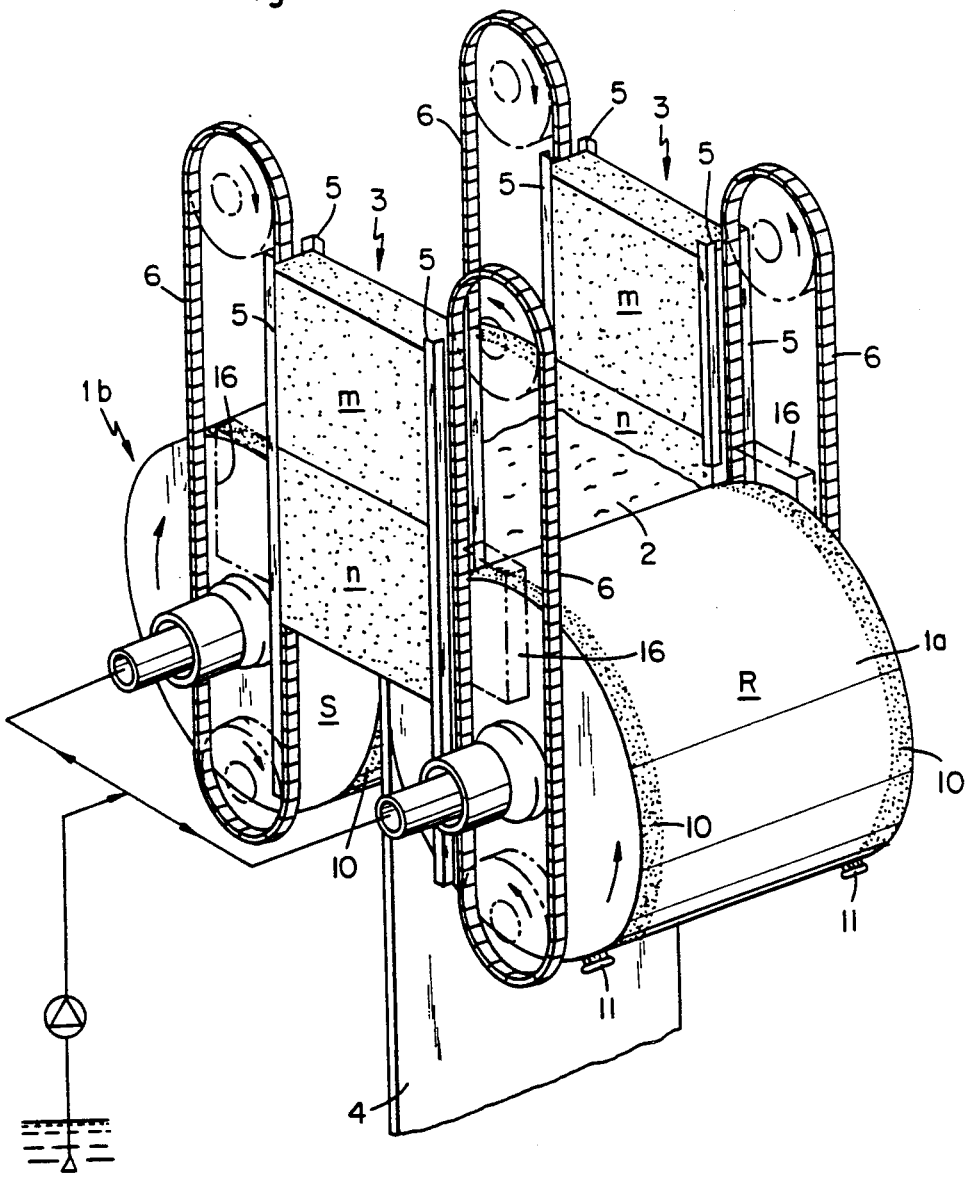
FIG. 1 is a perspective view showing principal portions of an embodiment of the apparatus according to the invention.

FIG. 1 illustrates an embodiment of the apparatus according to the invention under a stationary running of the apparatus. Reference numerals 1*a*, 1*b* designate a pair of internally cooled rolls which are opposed parallel to each other with their roll axes held horizontal and rotating in the opposite direction to each other (the rotational directions of both rolls are shown by arrows). In the illustrated embodiment the rolls 1*a*, 1*b* are internally cooled with water. More specifically, the rolls 1*a*, 1*b* are formed on the inside of drums constituting the circumferential surfaces R with cooling water paths (not shown). The circumferential surfaces R are adapted to be cooled to a predetermined temperature by water passing through the cooling water paths. Cooling water is supplied to and drained from the cooling water paths on the inside of the circumferential surface R through a shaft of each roll.

Reference numerals designate, 2 a molten metal in a pool formed on the circumferential surfaces R of the pair of rolls 1*a*, 1*b*, 3 a side dam as a whole, composed of a well-abradable material, 4 a cast strip, 5 a guide frame for guiding the side dam in the casting direction, and 6 an endless belt as a mechanism for feeding the side dam in the casting direction, respectively.

The side dam 3 is an assembly of stacked unit blocks designated with symbols n and m in FIG. 1. The unit blocks are composed of a well-abradable refractory material such as refractory brick, ceramic fiber board, boron nitride (BN) or the like. The unit blocks, except for the lowest one that is set in contact with the circumferential surfaces of the roll before the casting process is started, are rectangular plates having substantially the same size and shape. Necessary numbers of such unit blocks are supported by vertically fixed guide frames 5 (two unit blocks n and m are supported in the example shown in FIG. 1). The unit block in the form of a rectangular plate is supported along its four side edges by five L-shaped guide frames 5 which are vertically fixed so that the unit block may be slidably guided along the guide frames 5. The upper end of a space defined by the guide frames 5 is opened so that a fresh unit block may be freely added to the assembly existing in the space. In the assembly of stacked unit blocks existing in the space defined by the guide frames 5, the upper end of a certain unit block n is in contact with the lower end of another unit block m. In order that no clearance is formed between adjacent unit blocks in the stacked condition, every unit block is formed so that it has flat upper and lower end surfaces. To feed the side dam 3 of stacked unit blocks as a whole in the casting direction, the apparatus shown in FIG. 1 is provided with a feeding mechanism comprising endless belts 6. The feeding mechanism will be described in detain hereinafter.

In the embodiment shown in FIG. 1, every unit block is supported by the guide frames 5 at a side portion of the rolls so that when it comes in contact with rolls, a part of the thickness of the rectangular unit block may come on the circumferential surfaces of the rolls while the other part of the thickness of the unit block may go outside the circumferential surfaces of the rolls, and abrasively worn at its thickness portion contacting the circumferential surfaces of the rolls by feeding in the casting direction by means of the feeding mechanism. By this abrasion the unit block contacting the rolls takes a shape corresponding to the roll shape. FIGS. 2 and 3 depict the internal shape of the unit roll in contact with the rolls.

FIG. 2 shows an internal shape of the unit block contacting the circumferential surfaces of the rolls at the time the casting process is started. As seen from FIG. 2, of the whole thickness W of the unit block, a thickness $W_1$ of an inner portion is a thickness of a portion installed on the circumferential surfaces of the rolls (referred to herein as an overhang thickness), while a thickness $W_2$ is a thickness of a portion installed out of the circumferential surfaces of the rolls (referred to herein as a back-up thickness). In the overhang thickness portion $W_1$, curved bottom surfaces 7, 7' having been abraded so as to correspond to the circumferential shapes of the rolls 1*a*, 1*b* are formed, while in the back-up thickness portion $W_2$, back-up surfaces 8, 8' slidably contacting the side surface (shown by S in FIG. 1) of the rolls 1*a*, 1*b* are formed. While both the overhang and back-up portions $W_1$ and $W_2$, are made of a well-abradable refractory material in the illustrated example, the back-up portion which is not abraded may be made of a high-strength material.

FIG. 3 shows an internal shape of the unit block contacting the circumferential surfaces of the rolls under the condition where the degree of abrasion of the block is proceeded in the casting process. As shown in FIG. 3, side ends of the strip being cast abut on and abrade the lower edge 13 of the central portion of the curved bottom surfaces 7, 7' which have been abraded so as to correspond to the shape of the circumferential surfaces of the rolls. Curves a, a' shown by dotted lines in FIG. 3 show levels of interface between molten metal and thin shells solidified from the molten metal on the respective rolls. The solidified shells formed on the respective rolls are combined at a point A, and rolled in the gap between the rolls. Upon this rolling the width of the strip is outwardly expanded, and the side ends of the expanding strip abrade the side dams 3 at the above-mentioned lower edges 13. While the extent of this abrasion varies depending upon the thickness of the cast strip, casting rate and other casting conditions, it may exceed the width of the bottom surfaces 7, 7' that is the thickness of the side dam existing on the circumferential surfaces of the rolls (the overhang thickness $W_1$ as shown in FIG. 2). Even in such a case, however, the back-up surfaces 8, 8' slidably contacting the side surfaces of the rolls are present around the bottom surfaces 7, 7' and the lower edge 13 of the side dam 3, and restrain the expanding side ends of the strip being cast. Although a portion 15 abraded by the side ends of the cast film is formed on the back-up surface, a risk of molten metal leakage can be avoided by making the back-up thickness sufficiently large.

Portions of the circumferential surfaces of the rolls slidably contacting the bottom surfaces 7, 7' of the side dams 3 are formed into rough surfaces having an abrading ability. The rough surface portions (4 portions) are designated by reference numeral 10 in FIG. 1. If the roughness and hardness of the portions 10 are properly selected according to the material of the side dams 3 and casting conditions, abrasion of the bottom surfaces 7, 7' of the side dams 3 adequately proceeds during the casting process. The circumferential surfaces R of rolls in themselves may be roughened at appropriate portions to provide the rough surface portions 10 made of the same material as that of the rolls. However, the material of the circumferential surfaces R of the rolls is inherently selected in consideration of required thermal conductivity and formation of sound solidified shells. Accordingly, it is often advantageous to form the rough surfaces of a material other than that of the circumferential surfaces R on the portions 10 instead of roughening surfaces of the portions 10 of the circumferential surfaces R. For example, the portions 10 of the circumferential surfaces R may be provided with layers of a hard material, and surfaces of such layers may be roughened to impart them an abrading ability. The layers of a hard material may be formed by plating with a hard metal such as Ni and Ni-base alloys, Ni—Fe alloys. Cr and Cr-base alloys and Fe alloys; or by flame spraying of a hard metal such as Ni—Cr alloys, carbon steels and stainless steels, a ceramic such as $Cr_2O_3$, $TiO_2$, $Al_2O_3$ and $ZrO_2$, or a cermet such as $ZrO_2$—NiCr, $Cr_3C_2$—NiCr and WC-Co. By the way, a reference numeral 11 designates a brush for cleaning the rough surface portions 10. The brush 11 disposed in abutting engagement with the rough surface portion 10 acts to remove abraded powder generated by rotation of the rolls and attached to the rough surface portion 10, thereby preventing the rough surface from choking up with the abraded powder.

In the apparatus of FIG. 1, four L-shaped guide frames 5 having a length sufficient to guide an assembly of a plurality of vertically stacked upright rectangular unit blocks along the are disposed with their axes held vertical. The guide frames 5 support the unit blocks at four corners thereof and guide them along vertical four sides thereof. The guide frames 5 define a space for guiding the assembly of stacked upright rectangular unit blocks. The horizontal cross-section of the space corresponds to the horizontal cross-sectional area of the upright rectangular unit block, and the upper end of the space is open for the successive addition of fresh unit blocks. A pair of endless belts 6 for forwarding the assembly of stacked unit blocks are disposed so that they abut against side surfaces of the unit blocks exposed between the guide frames 5. A back-up member 16 is provided on the back of each endless belt 6 to urge the abutment of the belt against the side surface of the unit blocks. Side surfaces of the unit block are formed into rough surfaces so as to provide a sufficient frictional resistance against the endless belt 6. Alternatively, to the side surfaces of the unit block may be applied a thin layer of high-strength material capable of providing a sufficient abutting engagement against the endless belt 6. The pair of endless belt 6 for downwardly feeding the side dam 3 are driven at the same speed which is slower than the casting speed and should be adjusted so that the abrasion of the side dam 3 may properly proceed. During the casting process the state of the abrasion of the side dam 3 is monitored and a fresh unit block is added so that a sufficient area for damming molten metal may be always ensured. If the unit blocks are fabricated so that they have flat upper and lower surfaces, the addition of a fresh unit block may be done by simply inserting the fresh unit block into the space defined by the guide frames 5. If desired, however, adjacent unit blocks may be firmly joined together with an adhesive such as water glass.

Figure 4:
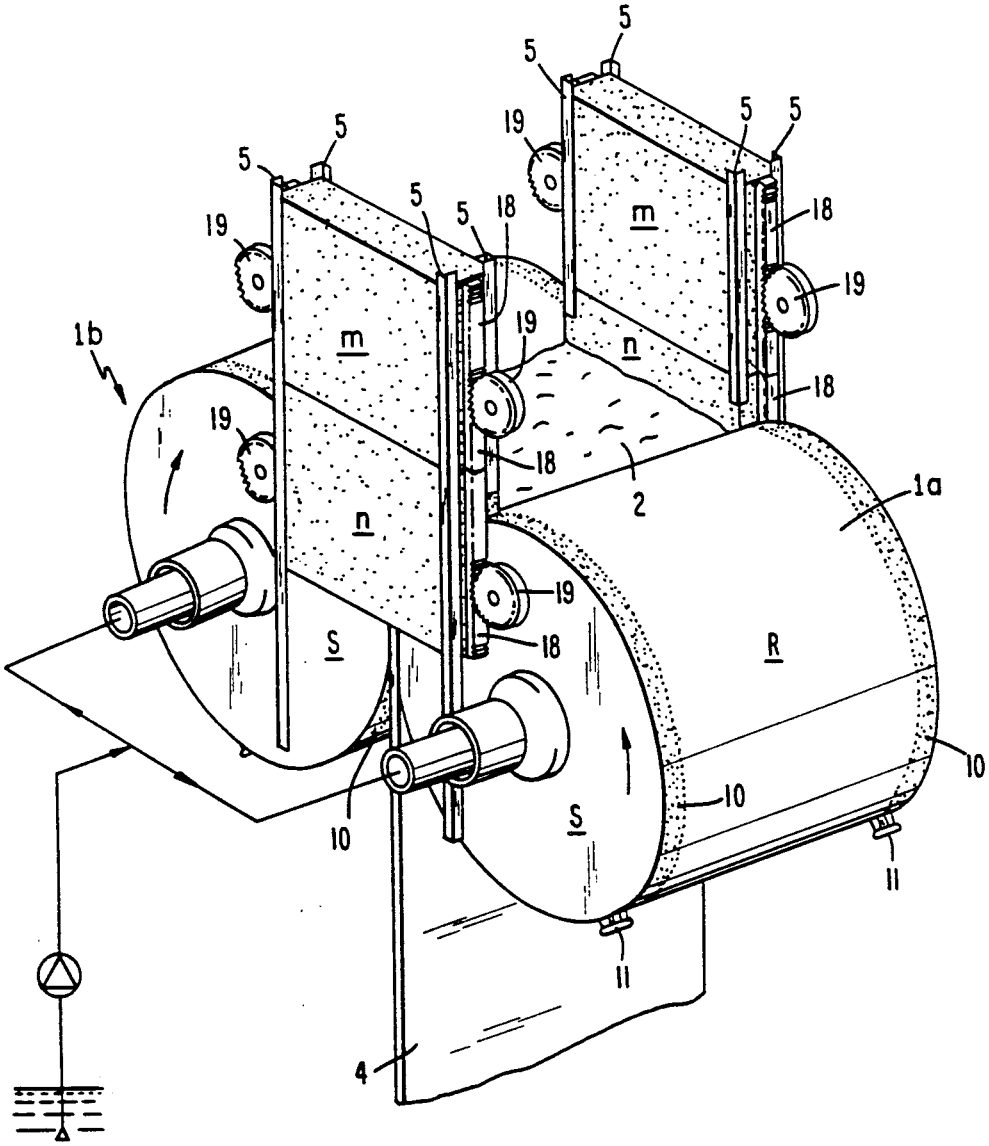
FIG. 4 is a perspective view showing principal portions of another embodiment of the apparatus according to the invention.

FIG. 4 shows an apparatus substantially the same as that of FIG. 1 except that the endless belt is replaced with a rack-and-pinion feeding system. The same reference numerals designate the same parts in FIGS. 1 and 4. In the apparatus of FIG. 4, a rack 18 is attached to each side of the side dam 3, and this rack 18 is moved by pinions 19. The rack 18 is composed of unit racks which may have or may not have the same length as that of the unit block. The unit rack or racks may be or may not be fixed to a side of the unit block. In the latter case the movement of the rack is transported to the unit block by friction.

Figure 5:
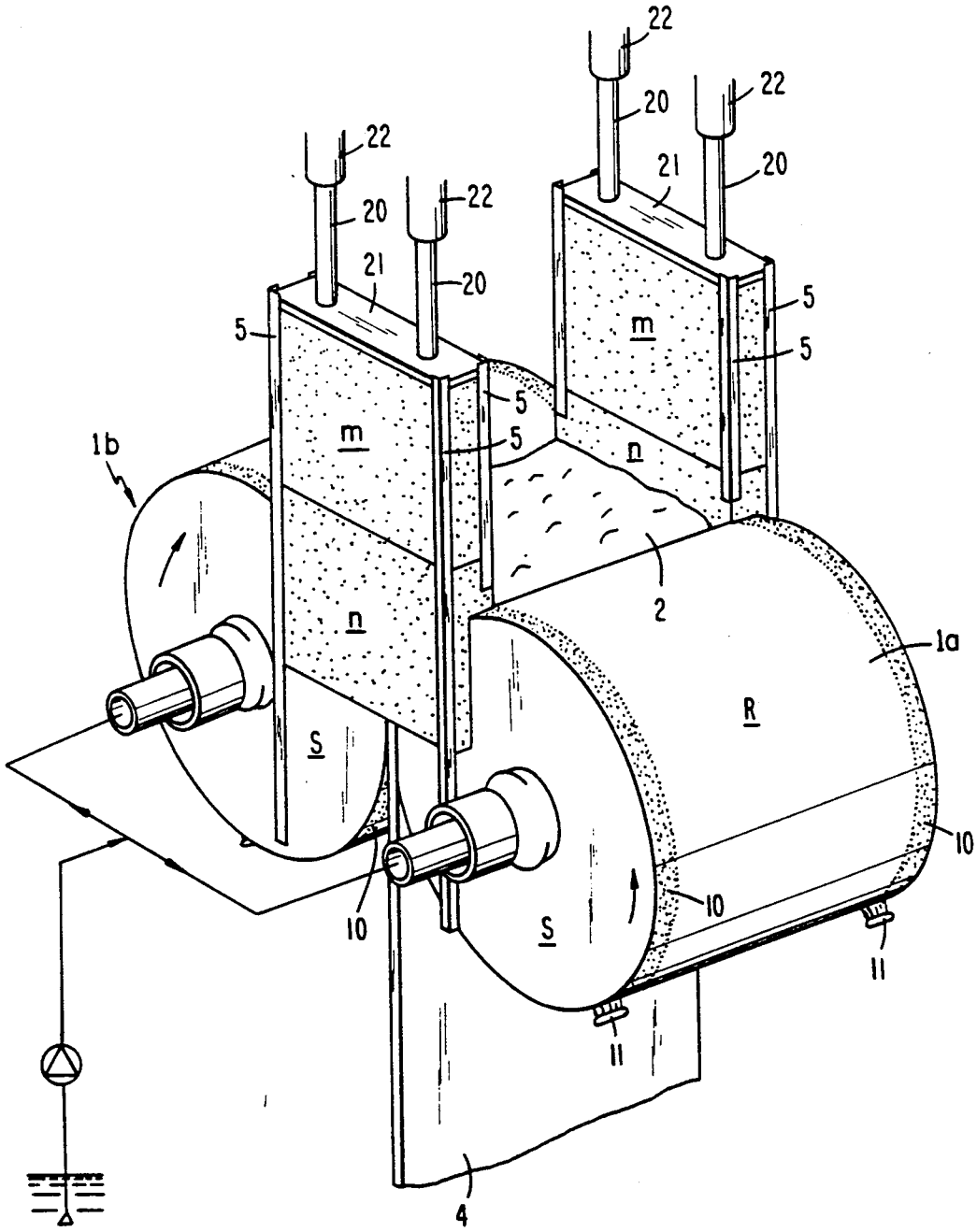
FIG. 5 is a perspective view showing principal portions of a further embodiment of the apparatus according to the invention.

FIG. 5 shows an apparatus substantially the same as that of FIG. 1 or 4 except that the side dam 3 is fed in the casting direction by means of forwarding rods 20 in the apparatus shown in FIG. 5. The side dam 3 is fed in the casting direction by applying forwarding rods 20 on the uppermost surface of the assembly of stacked unit blocks constituting the side dam 3 and downwardly drawing out the forwarding rods 20. In this case the forwarding rods 20 are preferably provided with a plate 21 on the lowest ends so that s load may be applied on the whole surface of the uppermost surface of the assembly constituting the side dam 3, may be driven by oil pressure of an oil cylinder 22, or alternatively by a screw driver system.

According to the invention the continuous production of a metal strip with a twin roll continuous casting machine based on the abradable dam system can be stably carried out for a long period of time by compensating the consumption of the side dams with the addition of fresh unit blocks, while enjoying the advantages of the abradable dam system.

We claim:

1. An apparatus for continously casting a metal strip comprising a pair of internally cooled rolls rotating in the opposite direction to each other and disposed parallel to each other with their axes held horizontal, a pair of side dams composed of a well-abradable refractory disposed with a space therebetween approximately corresponding to the width of a metal strip to be cast so that at least a portion of the thickness of each of the side dams is located on the circumferential surfaces of the rolls to form a pool of molten metal on the circumferential surfaces of the rolls, and a mechanism for feeding each of the side dams in the casting direction thereby continuously casting molten metal in the pool into a metal strip through a gap between the pair of rolls while abrading the side dams at their portions contacting the circumferential surfaces of the rolls with the circumferential surfaces of the rolls, characterized in that each of said abradable side dams comprises an assembly of successively stacked unit blocks in which one unit block except for the lowest one is placed on another unit block so that no clearance is formed between the lower end of the former and the upper end of the latter and that said mechanism for feeding each of the side dams is capable of feeding the assembly as a whole in the casting direction.

2. The apparatus for continuously casting a metal strip in accordance with claim 1 wherein each of said unit blocks is in the form of a rectangular plate.

3. The apparatus for continuously casting a metal strip in accordance with claim 1 wherein guide frames are provided for supporting the assemblies of stacked unit blocks so that they are slidable in the casting direction along the guide frames.

4. The apparatus for continuously casting a metal strip in accordance with claim 1 wherein said mechanism for feeding each of the side dams comprises a pair of endless belts rotating in opposite direction to each other for grasping the assembly of stacked unit blocks therebetween and forwarding the grasped assembly as a whole in the casting direction.

5. The apparatus for continuously casting a metal strip in accordance with claim 1 wherein said mechanism for feeding each of the side dams comprises racks attached to sides of the assembly of stacked unit blocks and pinions for imparting movement in the casting direction to said racks whereby said assembly is as a whole forwarded in the casting direction.

6. The apparatus for continuously casting a metal strip in accordance with claim 1 wherein said mechanism for feeding each of the side dams comprises forwarding rods disposed at the top of the assembly of stacked unit blocks for forwarding said assembly as a whole in the casting direction.

* * * * *